US007209336B2

(12) United States Patent
Yu

(10) Patent No.: US 7,209,336 B2
(45) Date of Patent: Apr. 24, 2007

(54) DOUBLE-PROTECTION CIRCUIT PROTECTOR

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 305 days.

(21) Appl. No.: 10/957,978

(22) Filed: Oct. 2, 2004

(65) Prior Publication Data

US 2006/0072275 A1 Apr. 6, 2006

(51) Int. Cl.
*H01H 37/52* (2006.01)
*H01H 85/02* (2006.01)

(52) U.S. Cl. ..... 361/105; 361/104; 337/362; 337/150; 337/190; 200/6 R; 200/400; 200/453

(58) Field of Classification Search ..... 361/104, 361/105; 337/362, 190; 200/6 R, 400, 449, 200/453

See application file for complete search history.

(56) References Cited

U.S. PATENT DOCUMENTS 3,913,049 A * 10/1975 Burch ..... 337/75
4,319,126 A * 3/1982 Lujic ..... 219/512
4,521,756 A * 6/1985 Forsell ..... 335/21
4,589,047 A * 5/1986 Gaus et al. ..... 361/42
4,975,666 A * 12/1990 Nobutoki ..... 335/78
6,741,159 B1 * 5/2004 Kuczynski ..... 337/403
6,842,095 B2 * 1/2005 Macbeth ..... 335/18

* cited by examiner

*Primary Examiner*—Stephen W. Jackson
*Assistant Examiner*—Z Kitov

(57) ABSTRACT

A circuit protector is connected in a circuit to protect the circuit from overloading. The circuit protector includes a casing inside which first and second terminals electrically connected to the circuit are fixed. A first cantilever member is fixed to the first terminal and has a cantilever arm that assumes a first shape in a normal condition and is convertible into a second shape in an overloading condition. A second member is supported in the casing by a pivot and has one end fixed to the second terminal by a fastener and an opposite end forming a contact engageable with the cantilever arm in the first shape and separable from the cantilever arm in the second shape. The fastener has a low melting point whereby an overloading causes the fastener to melt and break and thus allowing the second member to rotate and separating the contact from the cantilever arm. The second member is biased by a spring to facilitate separation of the contact from the second member when the fastener is broken.

15 Claims, 7 Drawing Sheets

DOUBLE-PROTECTION CIRCUIT PROTECTOR

BACKGROUND OF THE INVENTION

1. Field of the Invention

The present invention relates generally to a circuit protector that functions like a circuit breaker to protect a circuit from damage caused by overloading, undesired high temperature, and in particular to a circuit protector that is triggered by high temperature caused by overloading and the likes to open the circuit.

2. Prior Arts

Electricity is one of the most widely used energies in modern societies. Wide applications of electricity can be found in almost all fields, especially in a computerized, information-based society. Also, household electric appliances play a more and more important role in the modern societies. Such appliances are almost powered by electricity. Due to the wide applications of electricity in the modern societies, damage caused by improper use of electricity are often observed, especially fire catastrophes caused by overheating of electrical devices.

To ensure safety of using electrical power, a breaker is added in a home electrical circuit. The breaker is a normally-closed device, which allows for transmission of electrical power therethrough in a regular, normal operation, and automatically opens the home circuit when overloading, over-current, or overheating is detected in order to protect the circuit from damage caused by the overloading. It is also known that some electrical devices feature the same function of opening a circuit when overloaded. Similarly, switches are provided with the same function or a circuit protector for opening the circuit in an overloading condition.

FIGS. 1 and 2 of the attached drawings show a conventional circuit protector, comprising a conductive, resilient plate 201 having a convex shape whereby with a first end fixed to a first contact 202, an opposite, second free end forming a first terminal 203 is bent downward to have the first contact 203 physically engaging a second contact 205 mounted on a second terminal 204 and thus completing a closed circuit loop. The plate 201 features deformation and backward springing when overheated caused by overloading of the circuit. The backward springing makes the free end of the plate 201 disengaging from the second terminal 204, thereby opening the circuit and thus realizing circuit protection, as particularly shown in FIG. 2.

However, the conventional circuit protector suffers several drawbacks. For example, it is hard, if not impossible, to ensure the springing behavior of the resilient plate 21 due to manufacturing tolerance and material defects. Thus, the critical temperature at which the resilient plate 21 starts to spring backward cannot be controlled, which means significant deviation from a rated critical temperature may be observed. Further, the resilient plate 21 is not sensitive to temperature increase, which often results in significant time lag in opening a circuit when the circuit is overloaded. It often occurs in the conventional devices that the deformation of the resilient plate is not well controlled and an incomplete disengagement is observed between the resilient plate and a terminal, which means the circuit is still in an overloaded condition and is not properly protected by the protector. An even troublesome drawback of the conventional device is that, when the plate cools down after disengaging from an overloaded circuit, the plate may get back into contact with the circuit, leading to overloading of the circuit again, if the cause of overloading has not been removed. Repeated engaging and disengaging of the resilient plate with the circuit definitely does no good to the circuit and the electronic/electrical appliances connected thereto and may even cause severe damage to the appliances.

SUMMARY OF THE INVENTION

Thus, an objective of the present invention is to provide a circuit protector that reliably opens a circuit when the circuit is overloaded in order to protect the circuit.

Another objective of the present invention is to provide a circuit protector that eliminates damage caused by repeated opening and closing of a circuit connected to the protector.

In accordance with the present invention, to realize the above objectives, a circuit protector adapted to connect with a circuit to protect the circuit from overloading and comprising a casing inside which first and second terminals electrically connected to the circuit are fixed. A first cantilever member is fixed to the first terminal and has a cantilever arm that assumes a first shape in a normal condition and is convertible into a second shape in an overloading condition. A second member is supported in the casing by a pivot and has one end fixed to the second terminal by a fastener and an opposite end forming a contact engageable with the cantilever arm in the first shape and separable from the cantilever arm in the second shape. The fastener has a low melting point whereby an overloading causes the fastener to melt and break and thus allowing the second member to rotate and separating the contact from the cantilever arm. The second member is biased by a spring to facilitate separation of the contact from the second member when the fastener is broken.

The present invention will become more obvious from the following description when taken in connection with the accompanying drawings, which show, for purposes of illustration only, preferred embodiments in accordance with the present invention.

DETAILED DESCRIPTION OF THE PREFERRED EMBODIMENT

Figure 1:
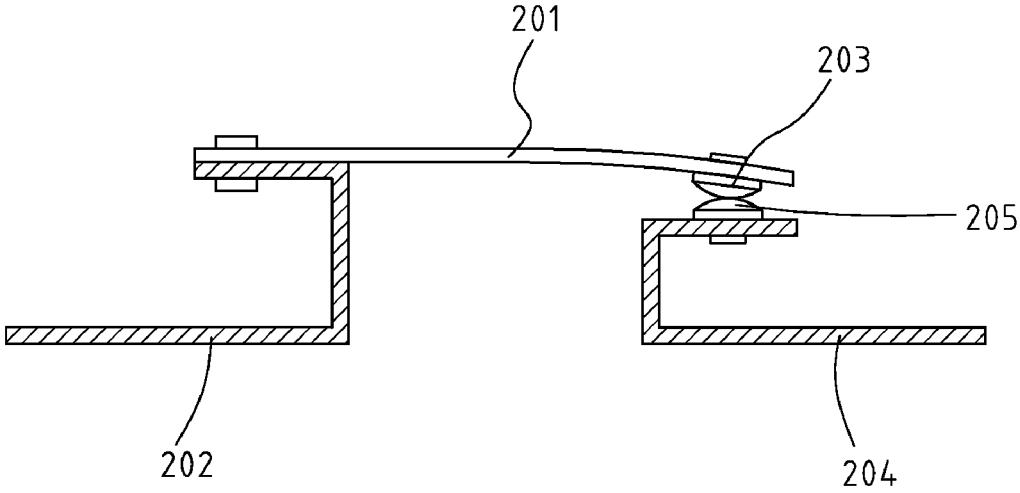
FIG. 1 (PRIOR ART)
FIG. 1 is a schematic cross-sectional view of a conventional circuit protector in a closed circuit condition.
Figure 2:
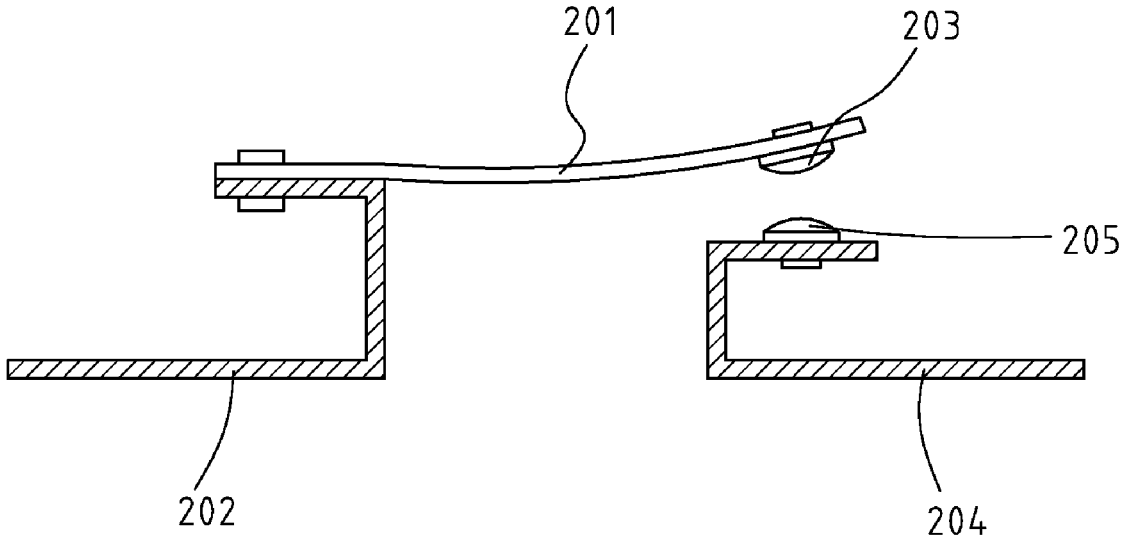
FIG. 2 (PRIOR ART)
FIG. 2 is similar to FIG. 1 but in an open circuit condition.
Figure 3:
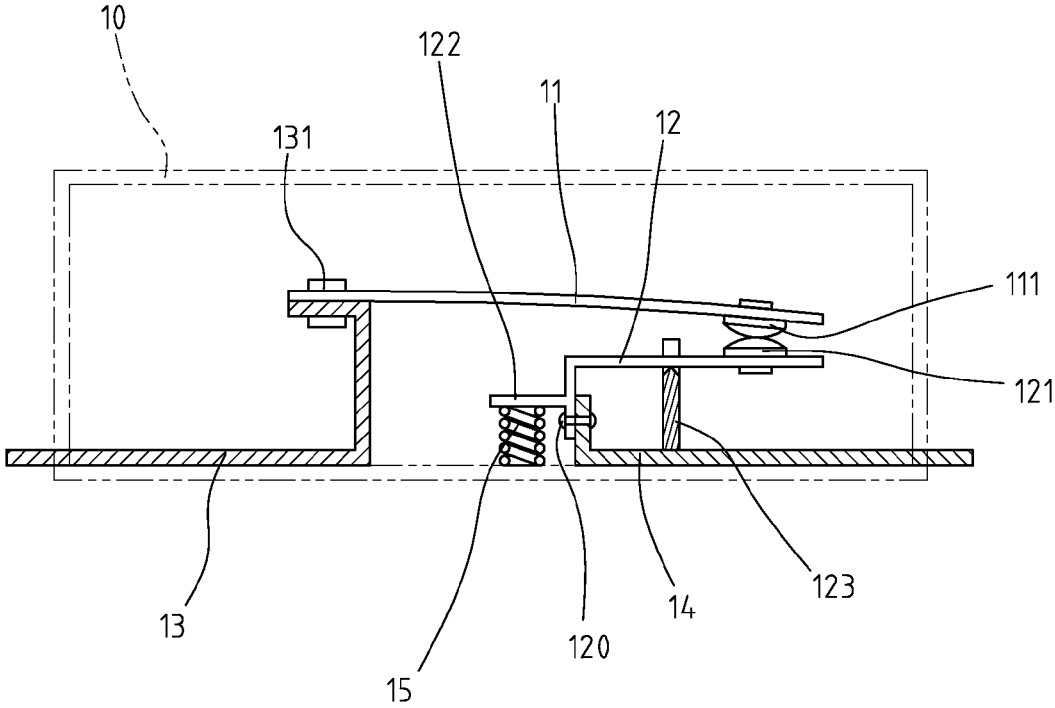
FIG. 3 is a schematic cross-sectional view of a circuit protector constructed in accordance with a first embodiment of the present invention, which is in a closed circuit condition.

Referring to the drawings and in particular to FIG. 3, a circuit protector constructed in accordance with a first embodiment of the present invention comprises a casing 10 (shown in phantom lines) defining an interior space in which first and second conductive terminals 13, 14, which are spaced from each other and are connectable to a circuit (not shown), are fixed. A conductive member 11 made of material that can spring backward when overheated is arranged as a cantilever arm, having a proximal end fixed to the first terminal 13 by a fastener 131, such as rivet, and a free, distal end extending from the first terminal 13. A first contact 111 is formed on the free end of the first terminal 13. An example of the cantilever arm 11 is a bi-metal member having top and bottom layers made of materials of different thermal expansion rate so that when the member is heated, the member warps or deflects due to difference in expanded length between top and bottom layers.

Figure 5:
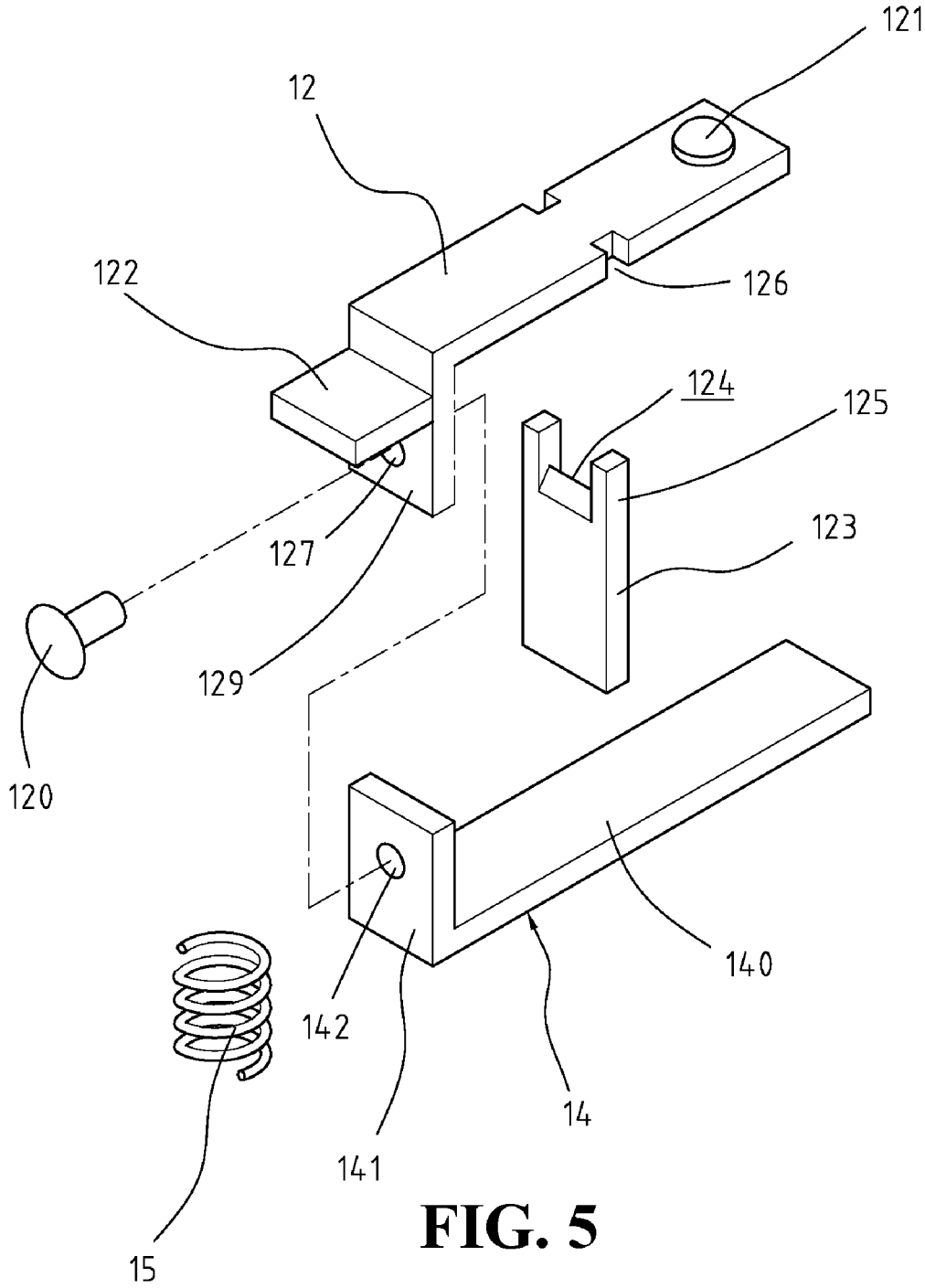
FIG. 5 is an exploded view of the circuit protector of the present invention with a casing removed.

Also referring to FIG. 5, an internal wall 123 is formed and fixed in the casing 10. A recess 124 is formed in an end of the wall 123 and delimited by opposite lugs 125. A seesaw plate 12 has longitudinal edges in which opposite notches 126 are defined. The seesaw plate 12 is received in the recess 124 with the notches thereof receiving the lugs 125 therein. Preferably, the recess 124 has a bottom forming a sharp ridge extending between the lugs 125.

The seesaw plate 12, which is made of electrically conductive material having a predetermined melting point, has an inner end fixed to the second terminal 14 by a fastener 120, such as a rivet made of a material having a melting point that is much lower than the predetermined melting point of the seesaw plate 12 (as well as that of the second terminal 14). An opposite distal end of the seesaw plate 12 forms a second contact 121, which, when the seesaw plate 12 is properly received in and supported by the recess 124 of the internal wall 123, corresponds in position to and is engageable with the first contact 111 of the cantilever arm 11.

In the embodiment illustrated, the second terminal 14 has a bottom 140 fixed to the casing 10 and a vertical section 141 defining a through hole 142. The seesaw plate 12 has a perpendicular extension 129 that overlaps the vertical section 141 of the second terminal 14. A through hole 127 is defined in the perpendicular extension 129 and aligns with the hole 142 for the extension of the rivet 120 therethrough to secure the seesaw plate 12 to the second terminal 14. Preferably, the first terminal 13 also has a vertical section (not labeled) opposite to the vertical section 141 of the second terminal 14 for supporting the cantilever arm 11.

A sideway projecting flange 122 is formed on the extension 129 of the seesaw plate 12 and opposes a bottom of the casing 10. A biasing element, such as a helical spring 15, is arranged between the flange 122 and the casing 10.

Figure 4:
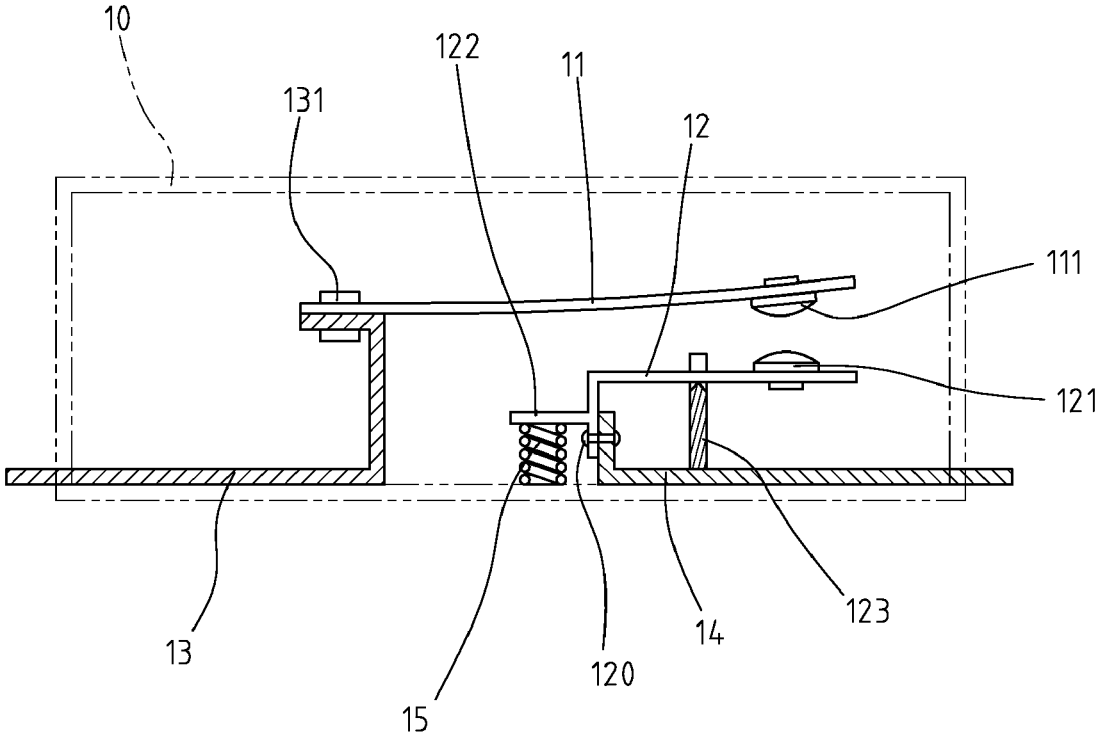
FIG. 4 is similar to FIG. 3 but in a regular open circuit condition caused by a primary protection mechanism.

The circuit protector in accordance with the present invention has two protection mechanisms, of which the primary mechanism will be described. The cantilever arm 11 is slightly bent downward in a convex form whereby the first contact 111 physically engages the second contact 121 to form a closed loop, allowing electricity to be supplied to the circuit connected to the first and second terminals 13, 14. In case of overloading, a large current flows through the cantilever arm 11, causing an increase of temperature of the arm 11, which forces the arm 11 to spring backward and warp or deflect upward in a concave form, as shown in FIG. 4. Thus, the first contact 111 is separated from the second contact 121 and the circuit is open, cutting off the current flowing to the circuit and thus protecting the circuit from damage caused by the large current.

Figure 6:
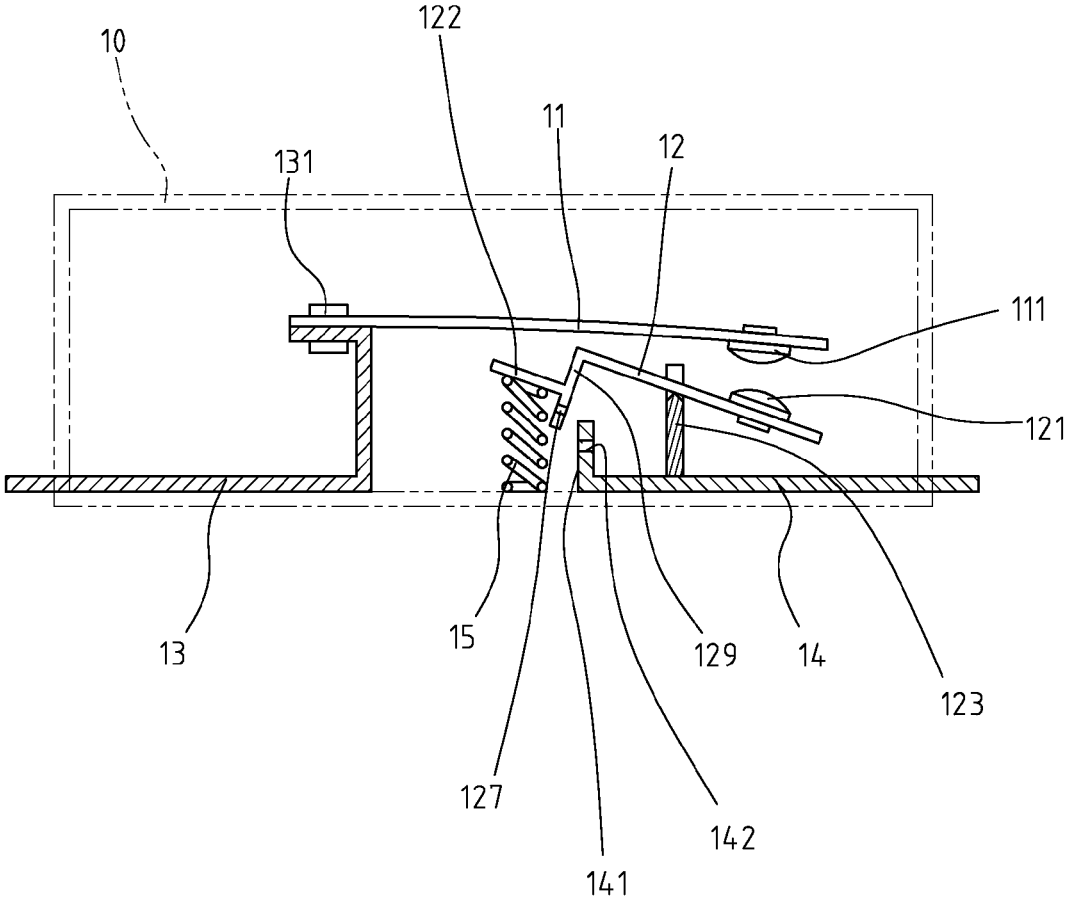
FIG. 6 is similar to FIG. 3, but showing the circuit protector in an auxiliary open circuit condition caused by a secondary protection mechanism.

The secondary protection mechanism will now be described. In case the primary protection mechanism fails, where the first contact 111 cannot be properly separated from the second contact 121 in an overloading condition, regardless of the temperature raise, the current continues flowing through the arm 11 and the seesaw plate 12, making further increase of temperature in the arm 11 and the plate 12. Such an increase of temperature eventually reaches the melting point of the fastener 120, which is much lower than the melting point of the seesaw plate 12. As shown in FIG. 6, the fastener 120 melts and the extension 129 of the seesaw plate 12 is released from the vertical section 141 of the second terminal 14. The biasing force of the spring 15 causes the seesaw plate 12 to rotate about the sharp edge of the recess 124, which separates the second contact 121 that is formed on the seesaw plate 12 from the first contact 111 that is formed on the arm 11. Thus, the electrical current flowing to the circuit is cut off and the circuit is protected from damage caused by the current.

Figure 7:
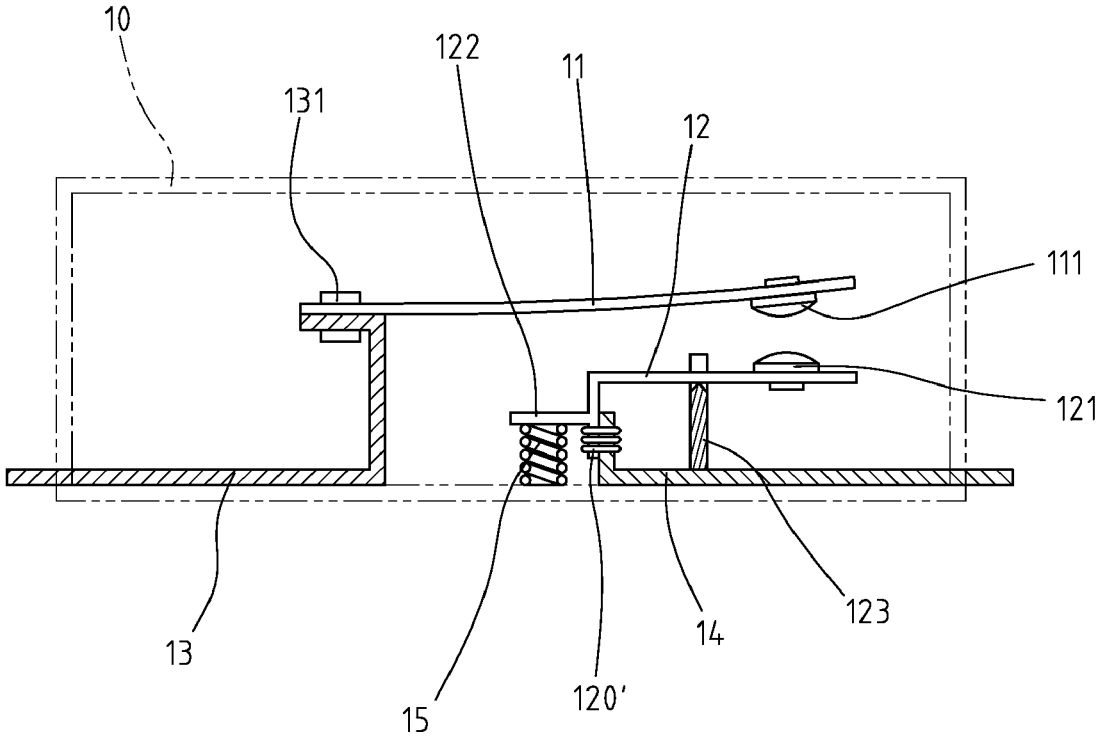
FIG. 7 is a cross-sectional view of a circuit protector in accordance with the present invention in a regular open circuit condition.

FIG. 7 shows another embodiment of the circuit protector in accordance with the present invention, which is substantially identical to the circuit protector discussed with reference to FIGS. 3–6, except that the fastener 120 that is adopted to fix the seesaw plate 12 to the second terminal 14 in the previous embodiment is now replaced by a wire 120' that tights the extension 129 of the seesaw plate 12 to the vertical section 141 of the second terminal 14. Similarly, in case of overloading and the cantilever arm 11 not undergoing backward springing, the temperature of the seesaw plate 12 continuously raises to the melting point of the wire 120' that is much lower than the melting point of the seesaw plate 12, leading to melting of the wire 120' and releasing the seesaw plate 12 from the second terminal 14. Thus, the seesaw plate 12, under the action of the biasing force of the spring 15, rotates and separates the second contact 121 from the first contact 111 to cut off the electrical current flowing into the circuit. The remaining portion of the current embodiment is exactly identical to the previous embodiment and no further description is needed.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A circuit protector comprising:

first and second terminals for electrically connecting to a circuit;

a first member fixed to the first terminal and having a first portion that assumes a first shape in a normal condition and is convertible into a second shape in an overloading condition; and a second member having a first segment fixed to the second terminal by a securing element having a first melting point that is lower than melting point of the second member, and a second segment forming a second portion that is engageable with the first portion when the first portion is at the first shape and that is separable from the first portion when the first portion is at the second shape; and a pivot member having a recess for receiving and supporting the second member in a seesaw form with the first segment on one side for connecting to the second terminal and the second segment on the other side for the second portion to contact the first portion;

wherein when an overloading occurs, temperature of the second member raises to the first melting point of the securing element, making the securing element molten and releasing the second member from the second terminal, which separates the second portion from the first portion.

2. The circuit protector as claimed in claim 1 further comprising a biasing element biasing the second member in a direction to have the second portion moved away from the first portion.

3. The circuit protector as claimed in claim 2, wherein when the securing element is molten and the first segment is released from the second terminal, the biasing force of the biasing element rotates the second member about the pivot member to have the second portion separated from the first portion.

4. The circuit protector as claimed in claim 2, wherein the biasing element comprises a helical spring.

5. The circuit protector as claimed in claim 1 wherein the pivot member comprises a wall having a top edge defining the recess delimited by opposite lugs, the recess having a bottom forming a sharp ridge, the second member forming notches on opposite edges thereof for receiving the lugs with the second member supported by the sharp ridge.

6. The circuit protector as claimed in claim 5, wherein the second member comprises a perpendicular extension overlapping a vertical section of the second terminal, aligned holes being defined in the extension and the vertical section, and wherein the securing element comprises a rivet made of a material having the first melting point and extending through the aligned holes.

7. The circuit protector as claimed in claim 5, wherein the second member comprises a perpendicular extension overlapping a vertical section of the second terminal and wherein the securing element comprises a wire made of a material having the first melting point and tightly surrounding the perpendicular extension and the vertical section that overlap each other.

8. The circuit protector as claimed in claim 1, wherein the first member comprises a bi-metal cantilever arm having a proximal end fixed to the first terminal and a distal end on which a contact functioning as the first portion is formed.

9. A circuit protector comprising:

an insulation casing;

first and second conductive terminals fixed inside the casing and extending beyond the casing for electrical connection with a circuit, the first and second conductive terminals being spaced from each other and having first and second vertical sections, respectively;

a first member having a proximal end fixed to the first vertical section of the first terminal and a distal end extending in a cantilever form, a first contact formed on the distal end of the first member, wherein the first member assumes a first shape in a normal condition and is convertible into a second shape in an overloading condition; and a second member rotatably fixed inside the casing by a pivot in a seesaw form and having opposite inner and outer ends on opposite sides of the pivot, the inner end being fixed to the second vertical section of the second terminal by a securing element having a first melting point that is lower than melting points of the second member and the second terminal, and the outer end forming a second contact engageable by the first contact when the first member is at the first shape and separable from the first contact when the first member is at the second shape, wherein when an overloading occurs, temperature of the second member and the second terminal raises to the first melting point, making the securing element molten and releasing the second member from the second terminal, which reliably separates the second contact from the first contact.

10. The circuit protector as claimed in claim 9 further comprising a biasing element biasing the second member in a direction to have the second contact moving away from the first portion.

11. The circuit protector as claimed in claim 9, wherein the biasing element comprises a helical spring.

12. The circuit protector as claimed in claim 9, wherein the pivot member comprises an internal wall of the casing, the wall having a top edge defining a recess delimited by opposite lugs, the recess having a bottom forming a sharp ridge, the second member forming notches on opposite edges thereof for receiving the lugs with the second member supported by the sharp ridge to form a seesaw.

13. The circuit protector as claimed in claim 12, wherein the second member comprises a perpendicular extension overlapping the second vertical section of the second terminal, aligned holes being defined in the extension and the second vertical section, and wherein the securing element comprises a rivet made of a material having the first melting point and extending through the aligned holes.

14. The circuit protector as claimed in claim 12, wherein the second member comprises a perpendicular extension overlapping the second vertical section of the second terminal and wherein the securing element comprises a wire made of a material having the first melting point and tightly surrounding the perpendicular extension and the second vertical section that overlap each other.

15. The circuit protector as claimed in claim 9, wherein the first member comprises a bi-metal cantilever arm.

* * * * *